US006683394B1

(12) United States Patent
Gevaert

(10) Patent No.: US 6,683,394 B1
(45) Date of Patent: Jan. 27, 2004

(54) POWER AND DATA DISTRIBUTION SYSTEM FOR BEAM-MOUNTED SEATING

(75) Inventor: Steven C. Gevaert, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 09/421,715

(22) Filed: Oct. 20, 1999

(51) Int. Cl.[7] ..... H02B 1/00

(52) U.S. Cl. ..... 307/147; 174/48; 297/332; 297/217.3

(58) Field of Search ..... 307/147; 297/333, 297/174, 325, 217.3, 232; 340/310.01; 174/50, 48

(56) References Cited

U.S. PATENT DOCUMENTS 4,879,849 A * 11/1989 Hollingsworth, III et al. .. 52/10
4,880,270 A 11/1989 Cooper ..... 297/188
5,214,314 A * 5/1993 Dillard et al. ..... 307/147
5,704,175 A 1/1998 Lewis ..... 52/288.1
5,807,177 A 9/1998 Takemoto et al. ..... 463/47
6,131,119 A * 10/2000 Fukui ..... 709/224

* cited by examiner

*Primary Examiner*—Josie Ballato
*Assistant Examiner*—Robert Deberadinis
(74) *Attorney, Agent, or Firm*—Andrus, Sceales, Starke & Sawall, LLP

(57) ABSTRACT

A power and data distribution system for use in combination with a beam-mounted seating structure that includes a series of seat assemblies each mounted to a common support beam. The power and data distribution system includes a wireway that is mounted to the support beam and extends along the entire row of seats. The wireway includes a concealed main electrical conduit that extends along the length of the power and data distribution system. The power and data distribution system includes a series of access housings that extend from the wireway, and each access housing includes a pair of electrical outlets and a pair of data outlets. Each of the electrical outlets is coupled to the main electrical conduit contained in the wireway, while each of the data outlets is connected to a data line also passing through the wireway. The power and data distribution system is separate from the seating structure and can be attached and removed from the seating structure independent from the construction of the seating structure.

50 Claims, 11 Drawing Sheets

FIG. 4
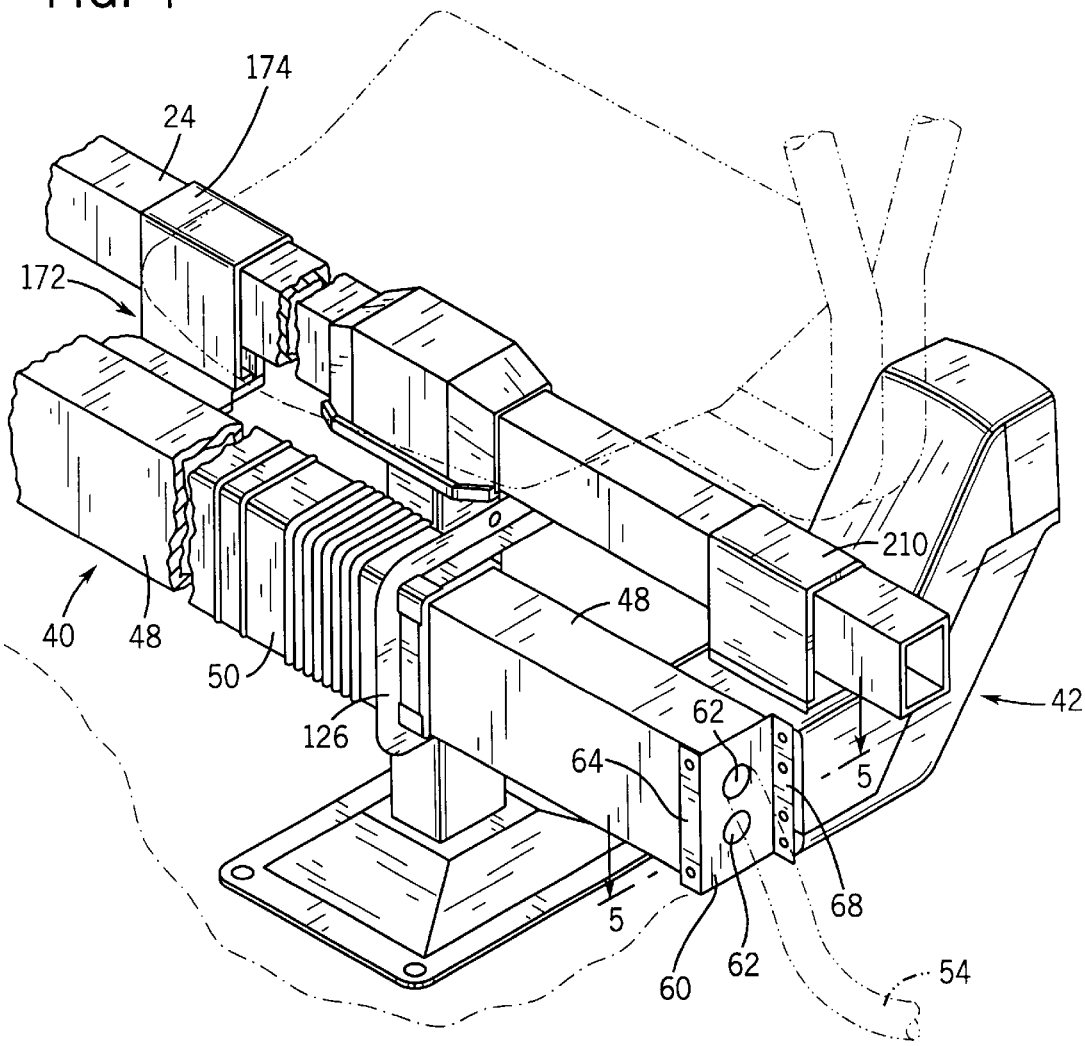
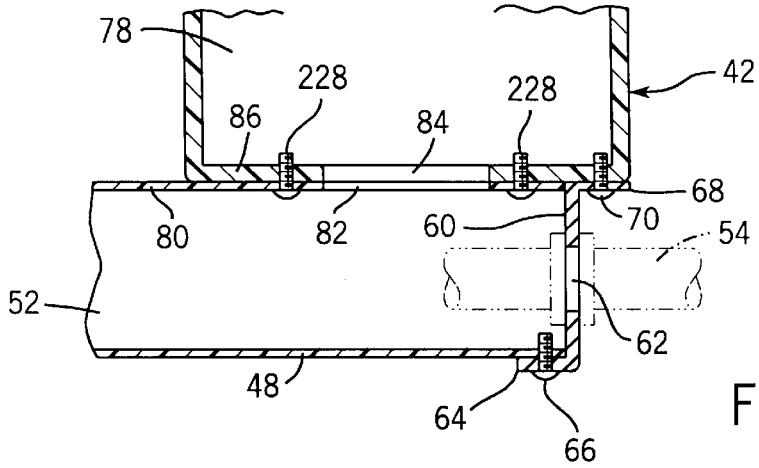
FIG. 5

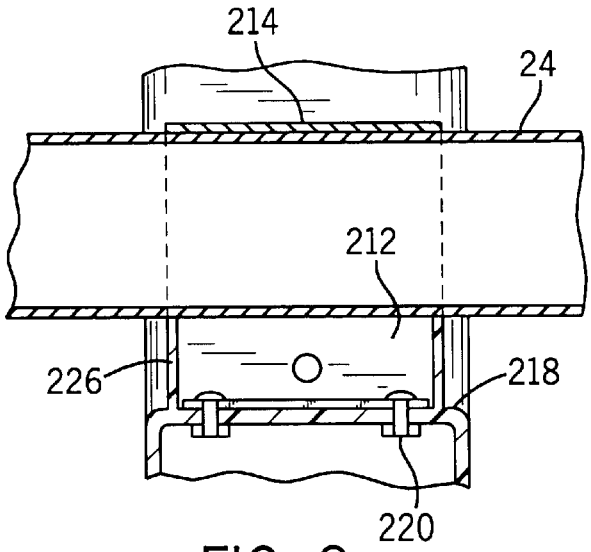
FIG. 8
FIG. 9
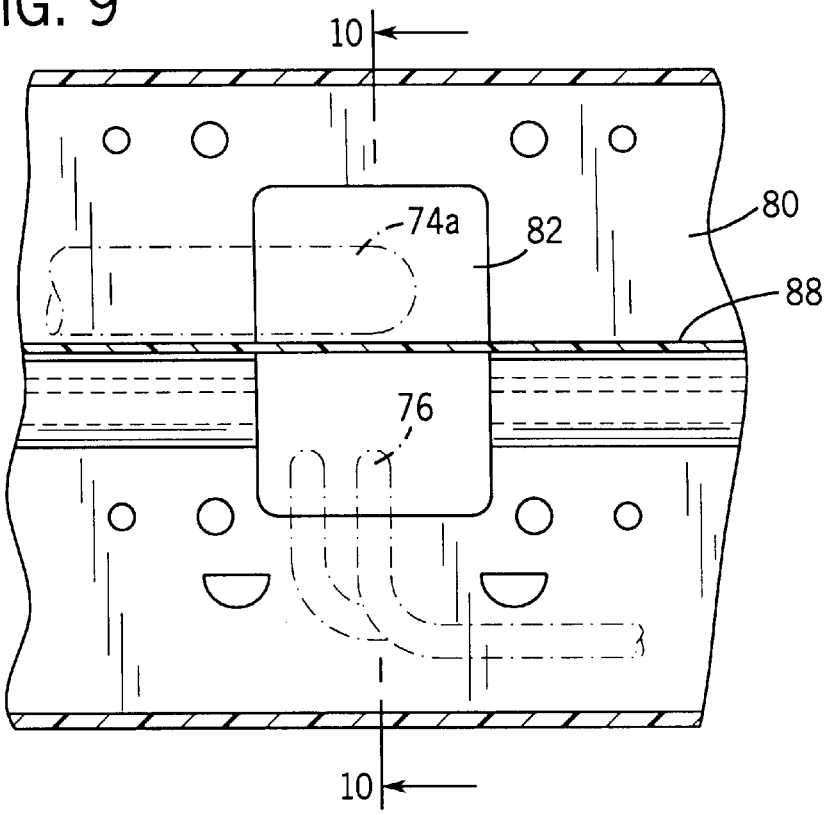

24
167
26
162
164
156
130
158
168
166
150
48
121
50
120
142
140
148
142
152
48
160
132
126
121
122
170
138
170
154
128
143
136
146
134

POWER AND DATA DISTRIBUTION SYSTEM FOR BEAM-MOUNTED SEATING

BACKGROUND AND SUMMARY OF THE INVENTION

The present invention relates broadly to a stationarily-mounted seating structure, such as is used in row formation in an auditorium, theater, or the like. More specifically, the present invention pertains to a power and data distribution system for use in connection with a beam-mounted seating structure having a plurality of individual seat assemblies aligned in a row and supported by a common support beam. The power and data distribution system of the present invention provides each seat occupant with access to an electrical outlet and at least one data outlet.

Beam-mounted seating structures are typically mounted to the floor of an auditorium, theater or the like, and generally include aligned rows of individual seats that are each mounted to a common support beam that in turn is mounted above the floor by spaced vertical uprights. This type of seating structure is often used in large auditoriums in which educational classes or other lectures are given. For example, such beam-mounted seating structures are often found in university auditoriums or lecture halls.

In recent years, laptop computers have become increasingly popular and are used by a large number of people on a daily basis. At some universities, for example, each student is required to have a laptop computer, which can be used by the student during interactive multi-media classes. During such classes, the student's laptop computer is plugged into a computer network and each student participates in the lecture and can access data from the university's computer network. In this type of classroom or lecture hall, a row of students sits behind a work surface in the form of a continuous desk top on seating which may or may not be interconnected with the supporting structure of the desk top. The desk top includes a plurality of spaced data outlets into which the students can connect their laptop computers.

While in such an interactive classroom, students operate their laptop computers off of the internal batteries contained within the laptop computer. Currently, internal computer batteries have only a limited battery life and they must be recharged by plugging the laptop computer into an electrical outlet. Thus, if the lecture or presentation lasts for an extended period of time, students operating laptop computers from battery power must either shut down their computers or plug the computers into an electrical outlet in the lecture hall to recharge the internal batteries.

It has been known to provide electrical outlets and data jacks at spaced locations along the desk top for receiving the plug of a computer or other accessory.

However, systems of this type are typically mounted to the desk top separate from the seating structure. It is not generally known to provide both electric and data outlets in a housing that extends from a wireway mounted to the support beam for the seating structure.

Therefore, it is an object of the present invention to provide a power and data distribution system associated with a beam-mounted seating structure having a plurality of individual seat assemblies mounted in a row and supported by a common support beam. An additional object of the invention is to position both an electrical outlet and a data outlet adjacent to each seat assembly to provide each seat occupant access to the electrical and data systems in the facility. It is a further object of the present invention to provide a wireway mounted to the support beam that conceals a main electrical conduit and data lines beneath the seating surface of each of the seat assemblies. A still further object of the invention is to provide a wireway that is coupled to the support beam for the beam-mounted seating structure to isolate the data lines and main electrical conduit from the seating structure. Further, it is an object of the present invention to provide a series of electrical/data access housings spaced along the wireway and positioned between successive pairs of seat assemblies, such that each access housing provides both data access and electrical power to two separate seat occupants. An additional object of the invention is to provide a power and data distribution system that can be installed on conventional beam-mounted seating structures to provide the desired data and electrical outlets for each of the seat occupants.

In accordance with one aspect of the invention, a seating structure is constructed having a row of spaced individual seat assemblies each supported upon a common support beam. A power and data distribution system is mounted to the seating structure and provides each seat occupant with access to at least one electrical outlet and at least one data outlet. The power and data distribution system includes a wireway that is mounted beneath the support beam and conceals an electrical conduit and a plurality of individual data lines. The wireway preferably is mounted below and behind the support beam for the seating structure and includes a series of access housings that extend from the wireway. Each of the access housings includes a pair of electrical outlets and a pair of data outlets. The power and data distribution system is configured such that an access housing extends between each pair of seat assemblies positioned along the seating structure, such that each seat assembly is provided access to both an electrical outlet and a data outlet.

The wireway of the power and data distribution system is mounted to the support beam for the seating structure by a series of mounting brackets, such that the wireway can be attached to the seating structure after the seating structure has been installed. Each access housing, in turn, is supported by both the wireway and the support beam of the seating structure.

In accordance with yet another aspect of the invention, the entire power and data distribution system is connected to the electrical power system of the facility in which the seating structure is installed through a single infeed electrical conduit that extends into the wireway. The infeed electrical conduit is coupled to a main electrical conduit that is completely concealed within the wireway mounted beneath the support beam. A branch electrical conduit extends from the main electrical conduit and into the access housing where it is connected to the pair of electrical outlets. Likewise, a pair of data lines extend from the wireway into the access housing where they are coupled to the pair of data outlets contained on each access housing.

In accordance with yet another aspect of the invention, the wireway mounted beneath the seating structure includes a back panel that can be opened to provide access to the data lines and electrical wiring concealed within the wireway. The movable back panel of each wireway section allows the electrical wiring and data lines to be installed after the wireway has been mounted beneath the seating structure.

In yet another aspect of the invention, the access housing mounted between the seating assemblies includes an upper attachment portion that is secured to both the wireway and the seating structure and a bottom drawer portion that is removably attached to the upper attachment portion. The removable bottom drawer portion of each access housing allows the access housing to be initially installed to the seating structure and provides access to the electrical wiring and data lines after the wireway has been mounted beneath the seating structure.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is an enlarged, partial isometric view illustrating the mounting arrangement between the power and data distribution system and the support beam of the beam-mounted seating structure;

FIG. 5 is a partial section view taken along line 5—5 of FIG. 4;

FIG. 8 is a partial section view taken along line 8—8 of FIG. 6 illustrating the interconnection between the support beam and the access housing;

FIG. 9 is a partial section view taken along line 9—9 of FIG. 6 illustrating the passage of the electrical conduit and data lines from the wireway into the access housing;

DETAILED DESCRIPTION OF THE INVENTION

Figure 1:
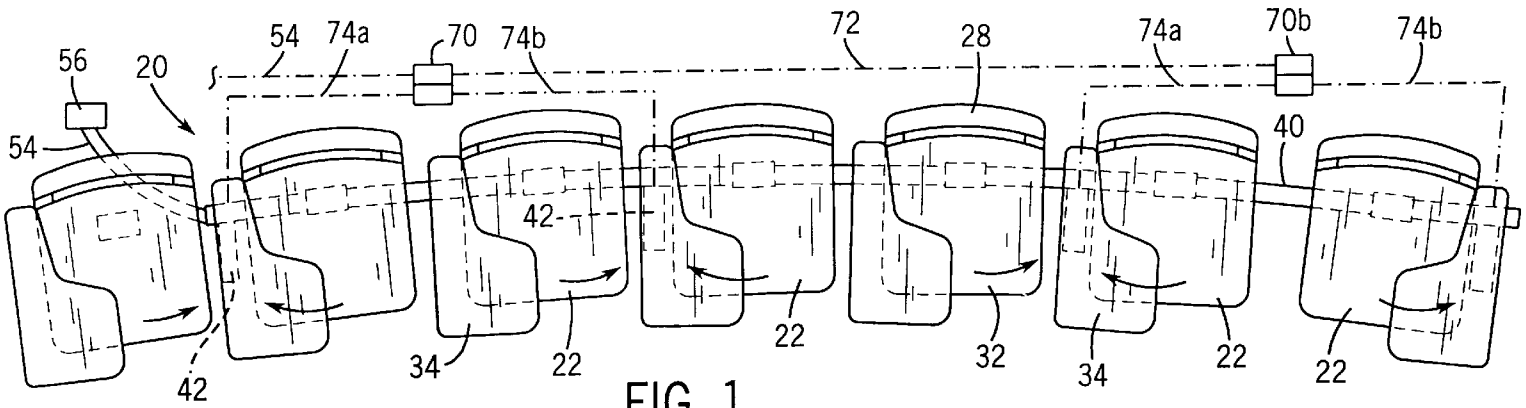
FIG. 1 is a top view of a beam-mounted seating structure and associated power and data distribution system of the present invention, illustrating a row of individual seat assemblies that each have access to an associated electrical outlet and a data outlet.
Figure 2:
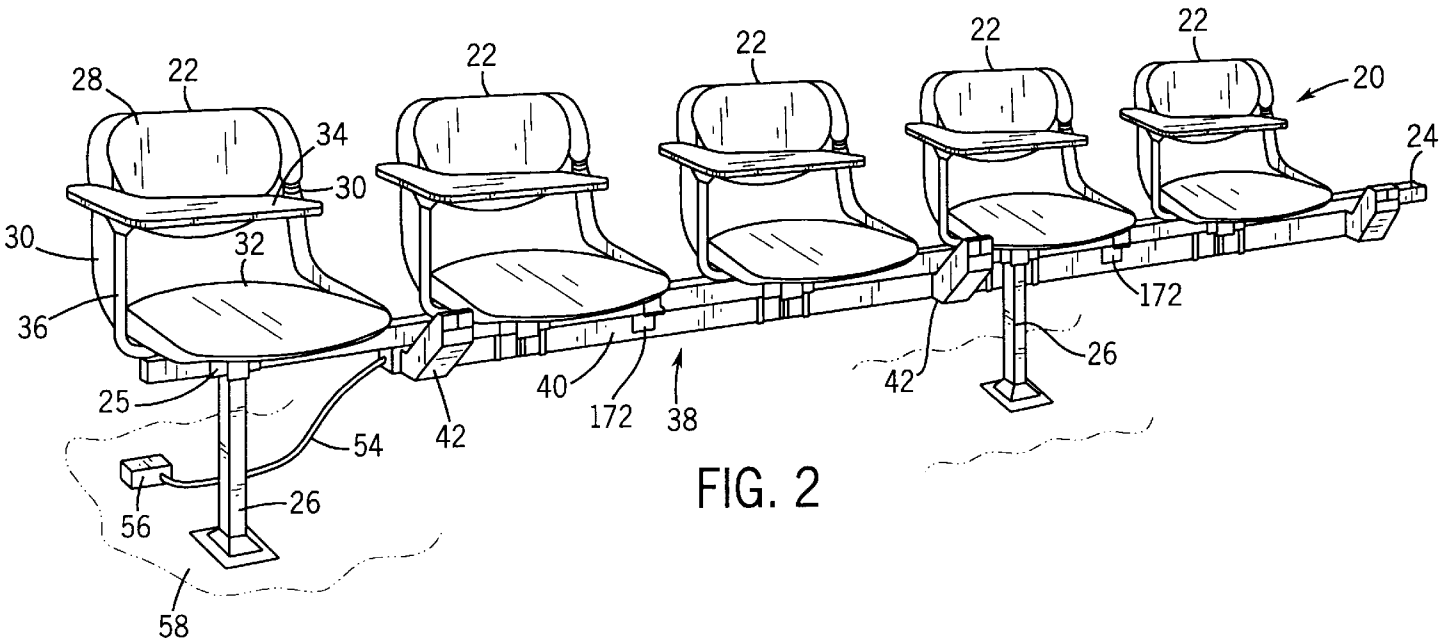
FIG. 2 is an isometric view of the seating structure and power and data distribution system of the present invention.

FIGS. 1 and 2 illustrate a beam-mounted seating structure 20 that is particularly useful in creating rows of aligned seats for use in large classrooms, halls, auditoriums, theaters or the like. The seating structure 20 includes a plurality of aligned individual seat assemblies 22 that form the row of seats. In the embodiment of the invention shown in FIG. 1, seven individual seat assemblies 22 are shown aligned in a row, although it should be understood that the seating structure 20 could include a greater or fewer number of aligned individual seat assemblies 22.

Each seat assembly 22 is mounted to a common support beam 24 that extends along the entire length of the row. Each seat assembly 22 is mounted to the support beam 24 in the conventional manner, such as by the seat mounting bracket 25 shown in FIG. 3. The support beam 24, in turn, is supported above the auditorium floor by a series of spaced vertical uprights 26. The vertical uprights 26 are spaced along the length of the support beam 24 to provide the required stability for the entire row of seat assemblies 22. In the embodiment of the invention shown in FIG. 2, the vertical uprights 26 are positioned under every fourth seat assembly 22 in the row.

Each seat assembly 22 generally includes a seat back 28 mounted by a spring loaded hinge assembly 30 to a seat 32. As shown in FIG. 2, each seat assembly 22 includes a tablet 34 positioned above the seat 32 by a tablet arm 36. The tablet 34 provides the seat occupant of each seat assembly 22 with a stable horizontal surface upon which the seat occupant can write or position his/her laptop computer for use during a lecture.

The construction of seating structure 20 as shown and described is known in the art, and is available from Krueger International, Inc. (KI) of Green Bay, Wis., the assignee of the present application, under its designation DORSAL model FSEQ-D-G. It is understood, however, that the present invention may be employed in any type of seating system in which seat assemblies are mounted to a common beam.

In accordance with the present invention, a power and data distribution system 38 is mounted below the row of seat assemblies 22 to provide the occupant of each seat assembly 22 with access to a supply of electrical power and a data connection to a central computer system for the facility and/or the Internet. As can best be seen in FIG. 2, the power and data distribution system 38 includes a wireway 40 mounted below the support beam 24 of the seating structure 20 and a series of electrical/data access housings 42 that each extend outwardly and upwardly from the wireway 40.

Figure 3:
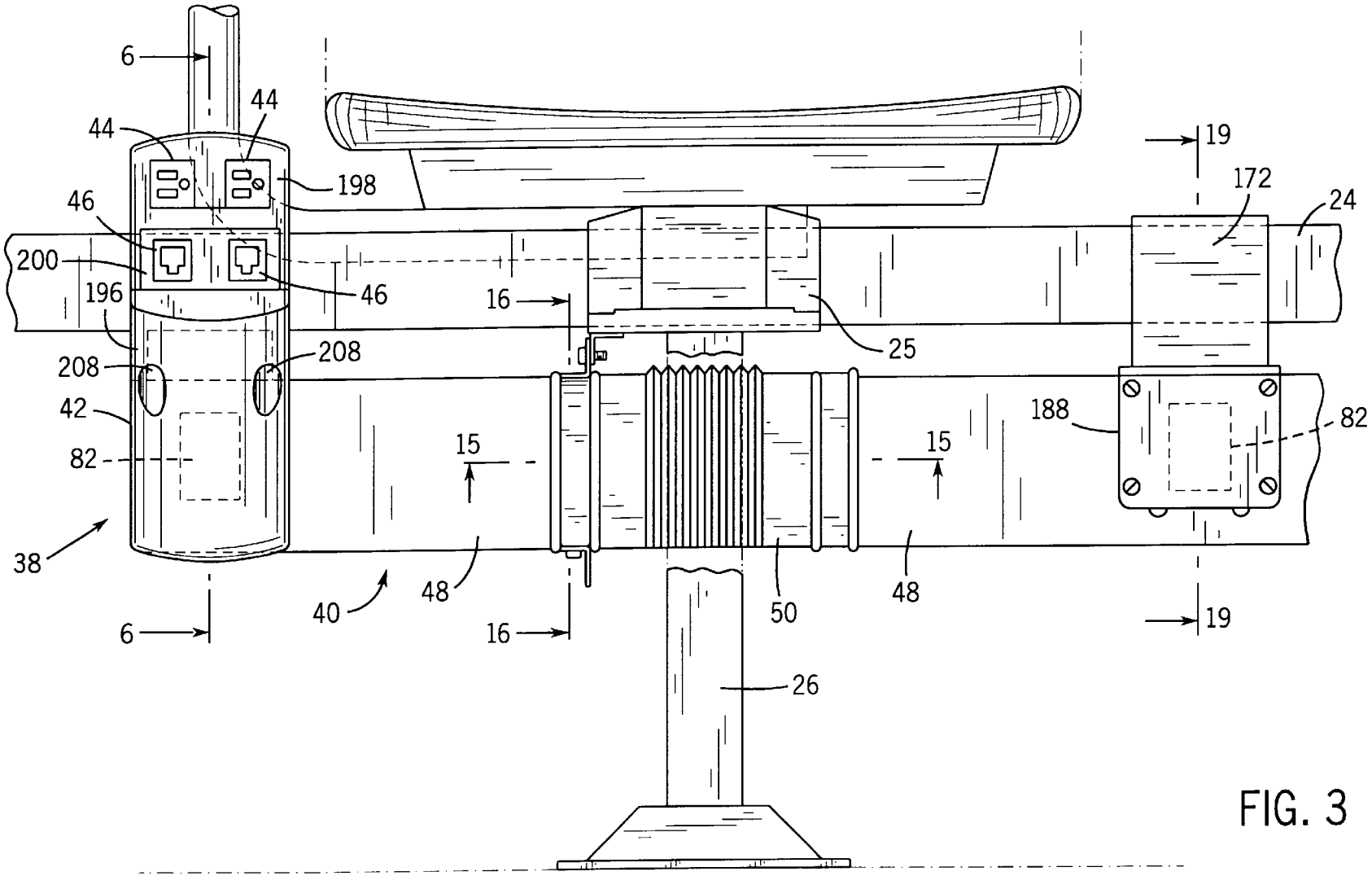
FIG. 3 is an enlarged, partial front view showing the power and data distribution system as mounted to the support beam of the beam-mounted seating structure, particularly illustrating the electrical/data access housing positioned between adjacent seat assemblies.

Each of the access housings 42 is positioned between a pair of the seat assemblies 22 and includes two electrical outlets 44 and two data outlets 46, as shown in FIG. 3. In the preferred embodiment of the invention, the two electrical outlets 44 are conventional three-prong outlets, while the data outlets 46 can be either conventional communication jacks, as shown, or Ethernet receptacles, depending upon the type of computer system available in the facility. Each access housing 42 provides the seat occupants seated on either side of each access housing 42 with access to both electric power and a data connection to the central computer system and/or the Internet. For example, in the embodiment of the invention shown in FIG. 2, the two leftmost seat assemblies 22 can access the leftmost access housing 42 such that each of the seat occupants can plug their laptop computers into the access housing 42. An identical access housing 42 is positioned between the next pair of seat assemblies 22 in the row such that each of the seat assemblies 22 is provided access to one of the access housings 42.

Referring now to FIGS. 3 and 4, the wireway 40 is mounted below and behind the support beam 24 for the row of seat assemblies 22. The wireway 40 is comprised of a plurality of wireway sections 48 that are each joined to an adjacent wireway section 48 by a bellows 50. The combination of the wireway sections 48 and the bellows 50 define the continuous wireway 40 positioned beneath the support beam 24 of the seating structure 20. Each wireway section 48 is a hollow, extruded plastic member that defines an open interior 52, as shown in FIG. 5. The open interior 52 defines a passageway for the electrical wiring and data lines to pass through the wireway 40 beneath the row of seat assemblies 22, as will be discussed in greater detail below.

As best shown in FIGS. 1 and 2, the entire row of the beam-mounted seating structure 20 is electrified by a single connection to a supply of electrical power through an infeed electrical conduit 54. The infeed electrical conduit 54 is connected to the electrical power system for the building by a junction box 56 contained on the floor 58 of the auditorium or lecture hall. The supply of electrical power preferably comes up through the floor 58 and is connected to the infeed electrical conduit 54 within the junction box 56. In one embodiment of the invention, the power infeed conduit 58 may consist of four 12-gauge wires and one 10-gauge neutral wire encased within a liquid-tight conduit that are hardwired in the junction box 56 to the building power supply.

As shown in FIG. 4, the wireway section 48 at the end of the wireway 40 terminates at an access plate 60 that includes a pair of openings 62 that allow the infeed electrical conduit 54 to enter into the open interior 52 defined by the wireway section 48. Referring now to FIG. 5, the access plate 60 includes an outer flange 64 that is joined to the outer wall of the wireway section 48 by a pair of screw connectors 66. An inner flange 68 extends from the access plate 60 and is joined to the access housing 42 by a second series of screw connectors 70.

As FIG. 1 schematically illustrates, the infeed electrical conduit 54 enters into the wireway 40 and terminates at a three-way connection plug 70. The three-way connection plug 70 includes three receptacles that each receive an end plug from additional electrical conduits. In the preferred embodiment of the invention, the infeed electrical conduit 54 including the three-way connection plug 70 is a commercially-available product from Pent, Inc. of Kendallville, Ind. under its model number 180016 and is commonly referred to as a UHI conduit. Additionally, each of the end plugs coupled to the three way connection plug 70 includes a simplex end plug that provides a conventional connection to the five wires of the infeed electrical conduit 54.

The connection plug 70 receives an end plug from a main electrical conduit 72 that extends through the wireway 40 and terminates at its own three-way connection plug **70*b*. While FIG. 1 illustrates only seven individual seat assemblies 22, it should be understood that additional main electrical conduits 72 can be coupled together using connection plugs 70*b* such that the electrical wiring can extend through the entire wireway 40 beneath the row of seat assemblies 22, regardless of the total number of seating assemblies 22**.

Referring back to FIG. 1, a pair of branch electrical conduits **74*a* and 74*b* are connected to the three-way connection plug 70 by corresponding end plugs. Each of the branch electrical conduits 74*a*, 74*b* extends from the three-way connection plug 70 and is connected to a pair of electrical outlets 44 contained in one of the access housings 42 positioned between a pair of seat assemblies 22. As can be seen in FIG. 1, the branch electrical conduit 74*a* provides electrical power for one access housing 42 while the branch electrical conduit 74*b* provides electrical power to a second access housing 42. In this manner, a single three-way connection plug 70 contained in the wireway 40 provides electrical power to four separate electric outlets 44 for four individual seat assemblies 22, while also providing a connection for the main electrical conduit 72 that supplies electric power to the remaining seat assemblies 22 of the seating structure 20**.

Although not shown in FIG. 1 or 2, a bundle of data lines pass through a data infeed opening formed in the floor 58 and enter into the wireway 40 at a selected location, such as for example, through an opening cut into the bottom wall of one of the wireway sections 48. Each of the data lines is connected to a central computer system (not shown) or similar structure for the building in which the seating structure 20 is installed. For example, if the seating structure 20 is installed in a university lecture hall, each of the data lines may be connected to the university computer system or a main computer being operated by a professor presenting the class. Each of the data lines that enter into the wireway 40 have one end coupled to one of the data outlets 46 contained on one of the access housing 42, as shown in FIG. 3. Since each individual seat assembly 22 is provided access to its own data outlet 46 and each data outlet 46 requires a separate data line, the number of data lines that are fed into the wireway 40 is based on the number of seat assemblies 22 contained in the row.

Although the present invention is described as including data lines that transmit computer related information, it should be understood that the "data" lines means any type of communication such as voice, data, fiber optics or various equivalents. In any event, the wireway 40 encloses and protects the "data" lines beneath the row of seating.

Figure 6:
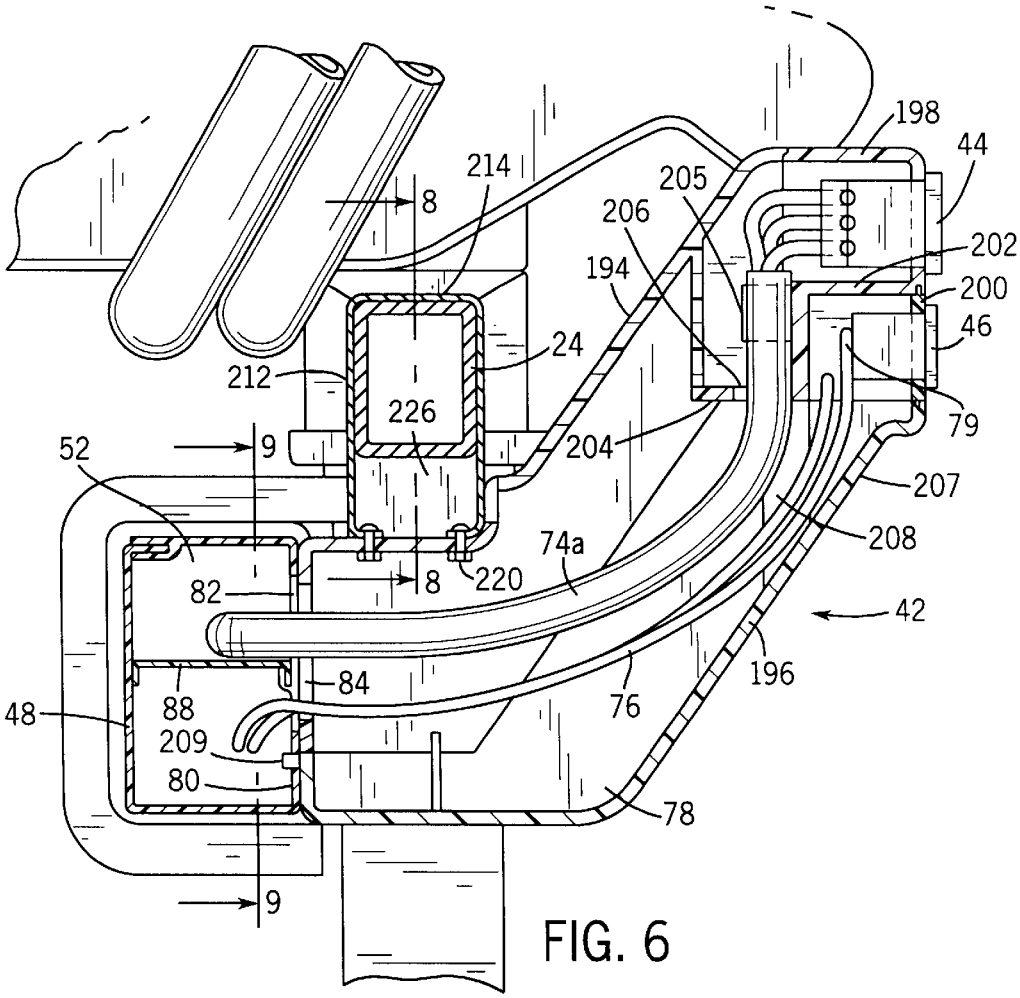
FIG. 6 is a section view taken along line 6—6 of FIG. 3 illustrating the passage of an electrical conduit and a pair of data lines from a wireway of the power and data distribution system into the access housing.

Referring now to FIG. 6, both the branch electric conduit **74*a* and a pair of the data lines 76 are shown passing from the open interior 52 of the wireway section 48 into the generally hollow, open interior 78 of the access housing 42. As can be seen in FIG. 6, the single branch electric conduit 74*a* is connected to the pair of electric outlets 44, while each of the data lines 76 has its first end 79 connected to one of the data outlets 46**.

Figure 7:
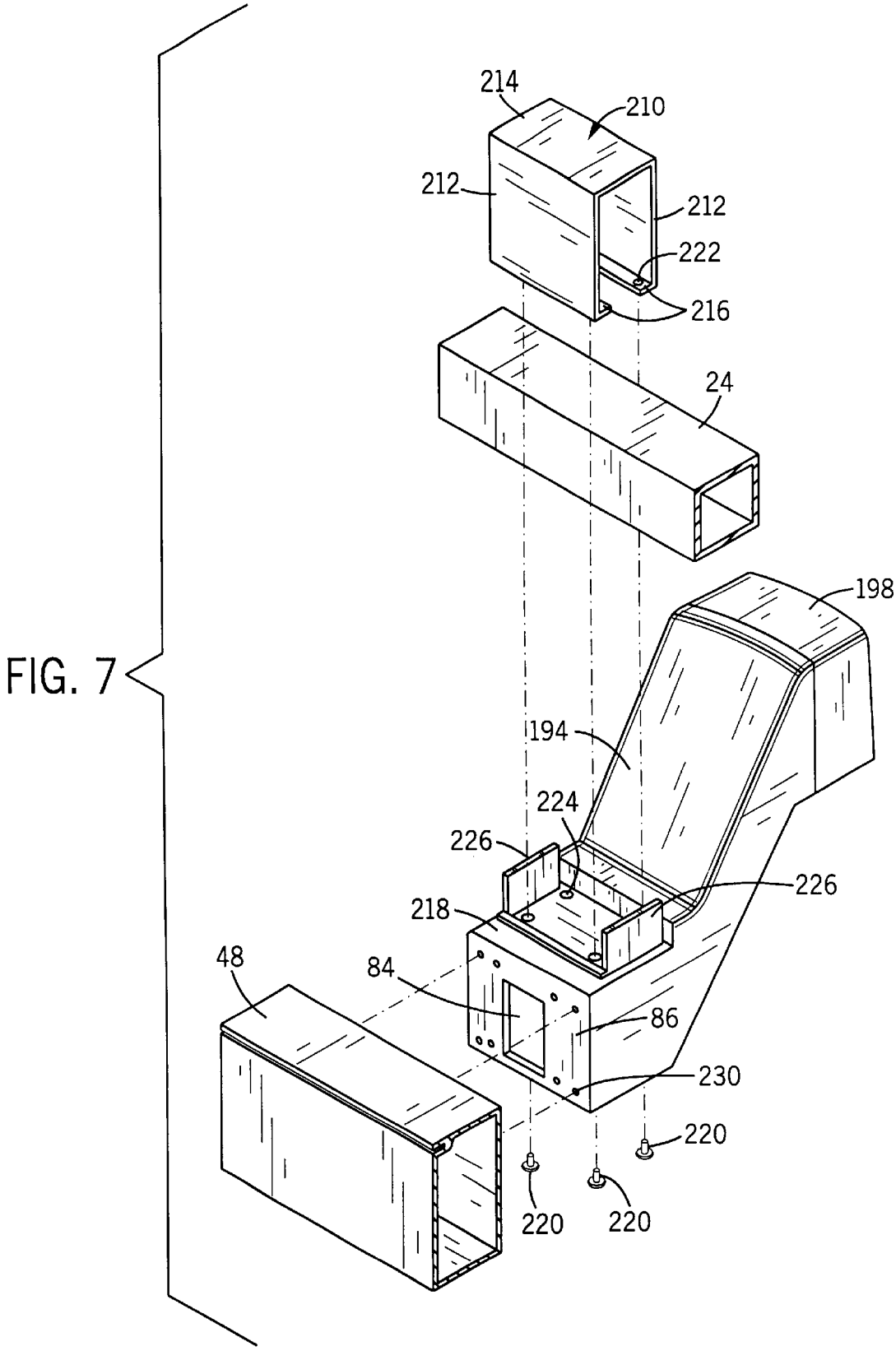
FIG. 7 is an enlarged, exploded isometric view illustrating the mounting arrangement between the access housing and both the wireway and the support beam of the beam-mounted seating structure.

Referring now to FIGS. 6 and 9, inner wall 80 of the wireway section 48 includes an opening 82 that permits the data lines 76 and branch electric conduit **74*a* to exit the open interior 52 of the wireway section 48. The access housing 42 also includes an opening 84 formed in the rear end 86 of the access housing 42, as shown in FIG. 7. When the access housing 42 is mounted to the wireway section 48, as shown in FIG. 6, the aligned openings 82 and 84 create a passageway between the open interior 52 of the wireway section 48 and the open interior 78 of the access housing 42 through which the branch electrical conduit 74***a* and data lines 76 can pass.

Figure 10:
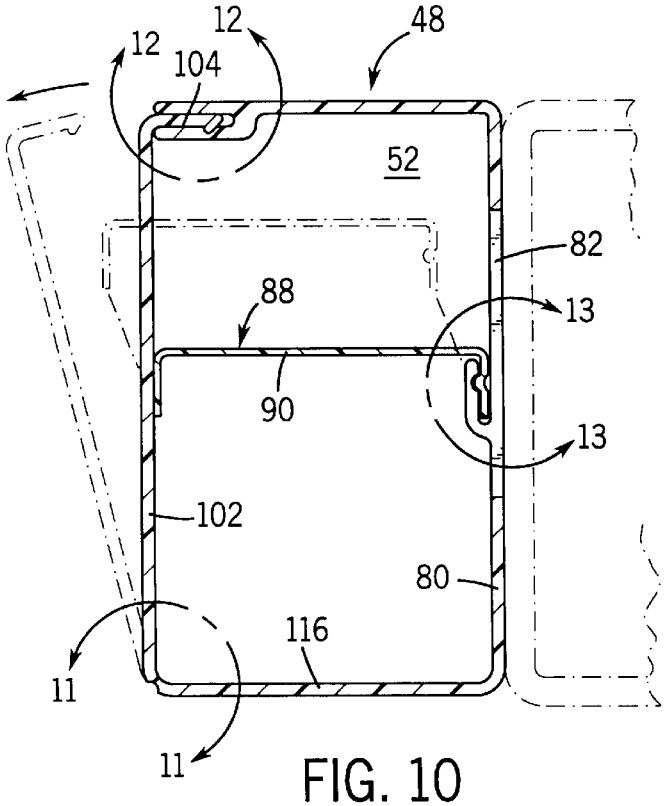
FIG. 10 is a section view taken along line 10—10 of FIG. 9 illustrating the movement of a back access panel of the wireway section.

As shown in FIGS. 6 and 10, a power/data divider 88 is mounted within each wireway section 48 to separate the data lines 76 from the electrical wires passing through the open interior 52. Since electronic data messages passing through the data lines 76 can be adversely affected by power surges within the electrical wires when the electrical wires and data lines 76 are in close proximity, the divider 88 provides physical separation between the data lines 76 and the electrical wires to prevent such adverse affects.

Figure 13:
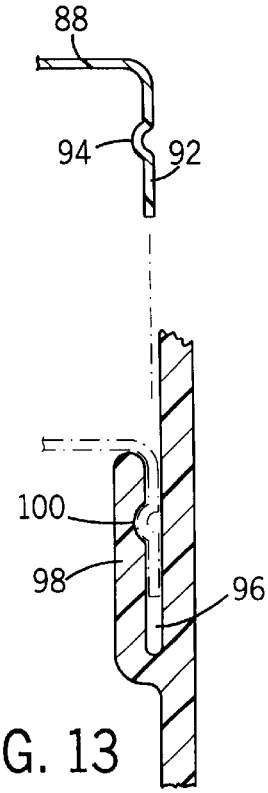
FIG. 13 is an enlarged section view taken along line 13—13 of FIG. 10 illustrating the mounting of a divider within the wireway section.

Referring now to FIGS. 10 and 13, the divider 88 extends along the entire length of the wireway section 48 and includes a generally horizontal shelf 90 that physically separates the data lines 76 from the electrical wiring. The horizontal shelf 90 is connected to a vertical mounting portion 92 that includes a detent 94. The vertical mounting portion 92 and detent 94 are received within a generally U-shaped channel 96 formed on the inside surface of the inner wall 80 of the wireway section 48. Specifically, a flange 98 extends from the inner surface of the inner wall 80 to define the U-shaped channel 96 that receives the vertical mounting portion 92 of the divider 88. The flange 98 includes a groove 100 that receives the detent 94 to retain the vertical mounting portion 92 within the U-shaped channel 96.

Figure 12:
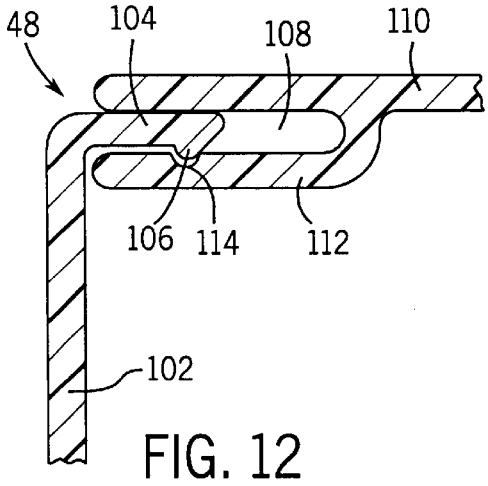
FIG. 12 is an enlarged section view taken along line 12—12 of FIG. 10.

As shown in FIG. 10, each wireway section 48 includes a back panel 102 that is movable between a closed, latched position and an open, access position shown in phantom. The back panel 102 is movable to the open position to allow access to the electrical wiring and data lines contained within the wireway 40 defined by the joined wireway sections 48. As shown in FIG. 12, the back panel 102 includes a horizontal latch portion 104 having a detent 106. Both the latch portion 104 and detent 106 extend along the entire length of the wireway section 48 and are received within a U-shaped channel 108 formed along top wall 110 of the wireway section 48. Specifically, a flange 112 extends from the top wall 110 and defines the channel 108 that receives the latch portion 104. A groove 114 formed in the flange 112 receives the detent 106 to securely hold the latch portion 104 in the closed position.

Figure 11:
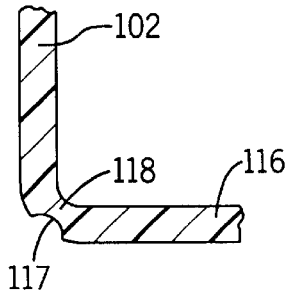
FIG. 11 is an enlarged section view of the area illustrated by line 11—11 of FIG. 10.

Referring now to FIGS. 10 and 11, the connection between the back panel 102 and bottom wall 116 of the wireway section 48 includes a groove 117 of removed material that defines a hinge 118. The hinge 118 allows the molded plastic back panel 102 to flex outward and provide access to the open interior 52 of the wireway section 48.

Figure 14:
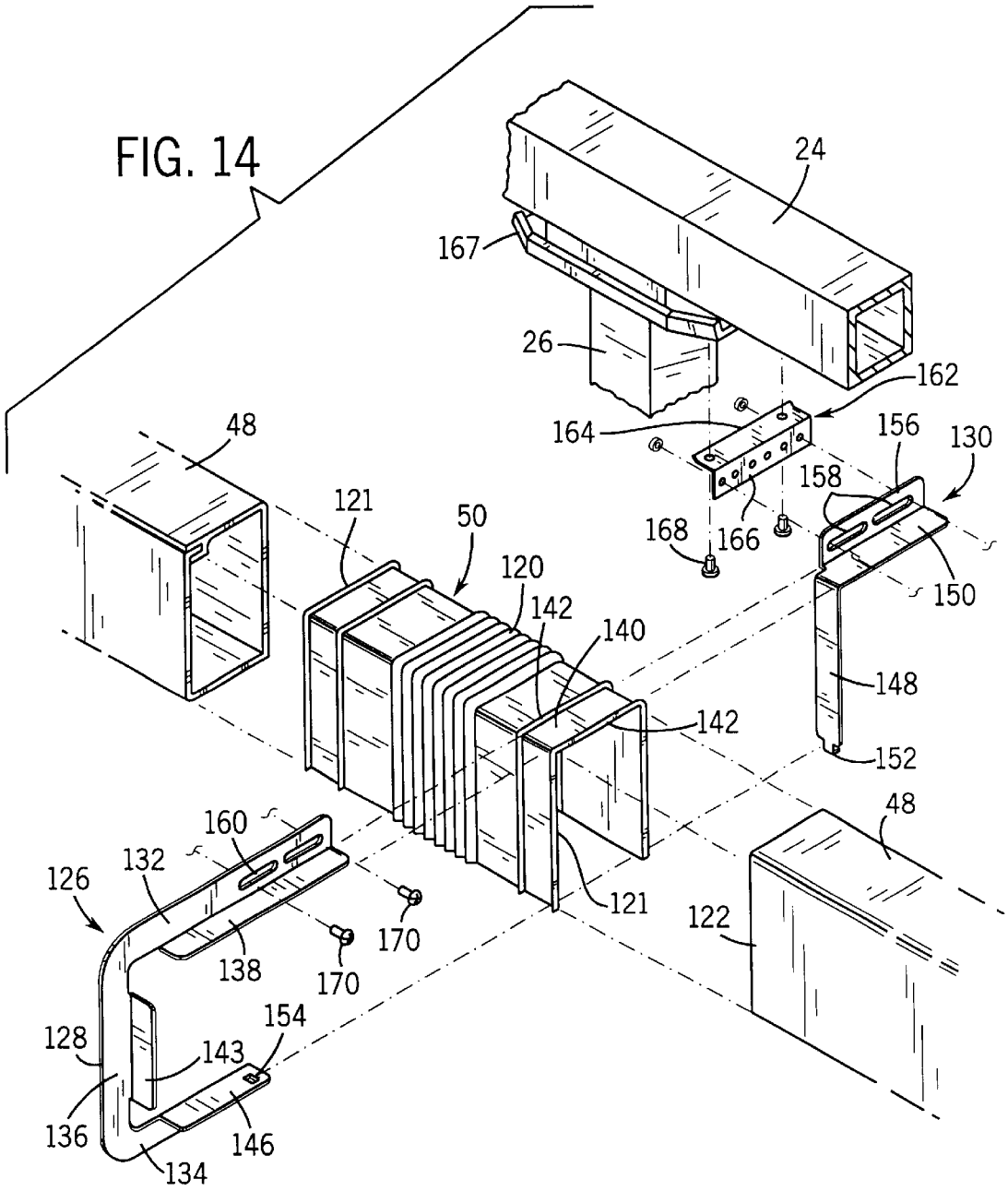
FIG. 14 is an exploded isometric view illustrating the mounting connection between the wireway and the support beam of the beam-mounted seating structure.

As previously discussed, the wireway 40 is constructed from a plurality of consecutive wireway sections 48 that are each joined to the adjacent section by a bellows 50, as shown in FIG. 14. Each wireway section 48 has a length generally corresponding to the distance between adjacent seat assemblies 28. In the preferred embodiment of the invention, the power and data distribution system 38 includes both short and long wireway sections 48 to compensate for the variable seat spacing necessary to creates straight aisles. For example, a short wireway section is utilized for seat spacing of 22" to 26", while a long wireway section 48 is used for 26" to 30" seat spacing.

The bellows 50 is a molded plastic component that includes a ribbed section 120 positioned between the two ends 121 of the bellows 50. The ribbed section 120 allows the bellows 50 to slightly extend and retract to provide a somewhat flexible coupling between the wireway sections 48. In addition, the flexible bellows 50 allows the wireway 40 to be installed on a radius beam layout in which each row of seats has an arcuate shape. The combination of the multiple wireway sections 48 and the flexible bellows 50 allows the wireway 40 to conform to the curved support beam 24 in a radius beam layout.

Figure 15:
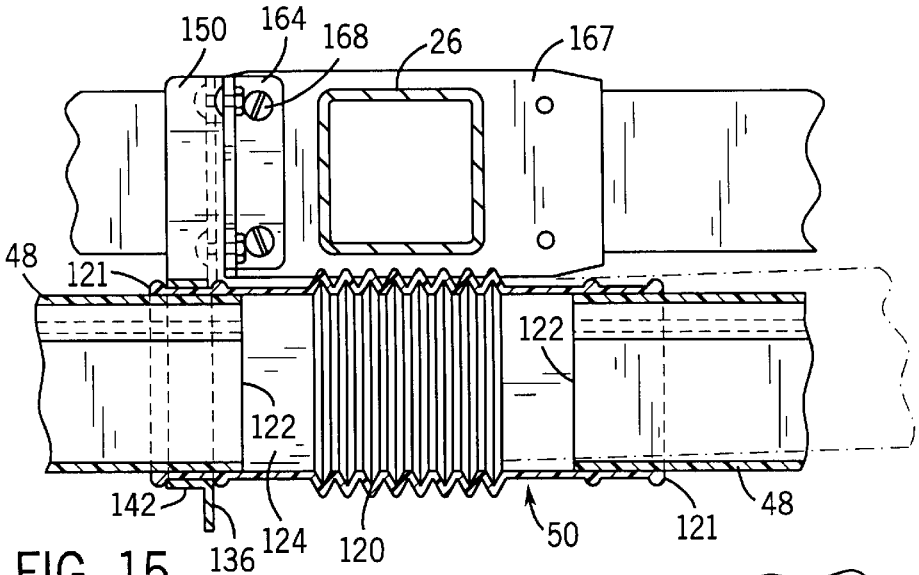
FIG. 15 is a partial section view taken along line 15—15 of FIG. 3.

The bellows 50 defines a generally U-shaped channel that opens downward and receives the pair of wireway sections 48 at its opposite ends 121. As can be seen in FIG. 15, outer end 122 of each wireway section 48 extends into the bellows 50 a distance that is significantly less than half of the overall length of the bellows 50 between its two ends 121. In this manner, the bellows 50 defines an open interior 124 through which the electrical wiring and data lines pass between adjacent wireway sections 48.

Referring back to FIG. 14, the wireway 40, and specifically the bellows 50, is mounted to the support beam 24 beneath each seat assembly 22 by a bellows support bracket 126. The bellows support bracket 126 generally includes a first portion 128 and a second portion 130 that are connected to form the complete bellows support bracket 126. The first portion 128 is generally C-shaped and includes an upper attachment flange 132, a lower attachment flange 134 and a back flange 136. The upper attachment flange 132 is joined to a horizontal upper wing 138. The upper wing 138 is received within a retaining channel 140 formed on the bellows 50 when the first portion 128 of the bellows support bracket 126 is slid into the supporting position shown in FIG. 17. The retaining channel 140 is defined by a pair of ribs 143 formed on the bellows 50 to prevent the upper wing 138 from moving laterally with respect to the longitudinal length of the bellows 50 when the first portion 128 is installed as shown in FIG. 16.

When the first portion 128 of the bellows support bracket 126 is slid into position, a vertical wing 143 extending from the back flange 136 is received in the vertical portion of the retaining channel 140, as defined by the ribs 142. When the bellows support bracket 126 is installed as shown in FIG. 16, a bottom wing 146 extending perpendicularly from the lower flange 134 closes the bottom of the bellows 50 and provides support for the outer end 122 of the wireway section 48.

The second portion 130 of the bellows support bracket 126 is generally L-shaped and includes a vertical flange 148 and a joined horizontal flange 150. The vertical flange 148 includes a hook member 152 that is received within a slot 154 formed near the end of the bottom wing 146 of the first portion 128, as shown in FIGS. 14 and 16. When the hook member 152 is inserted into the slot 154, the vertical flange 148 is received within the retaining channel 140 extending along the sidewall of the bellows 50. In this manner, the combination of the first portion 128 and second portion 130 of the bellows support bracket 126 encompasses the bellows 50 and is retained in the channel 140. The complete bellows support bracket 126 provides a means of attaching the bellows 50 and supports the outer end 122 of the wireway section 48.

Figure 16:
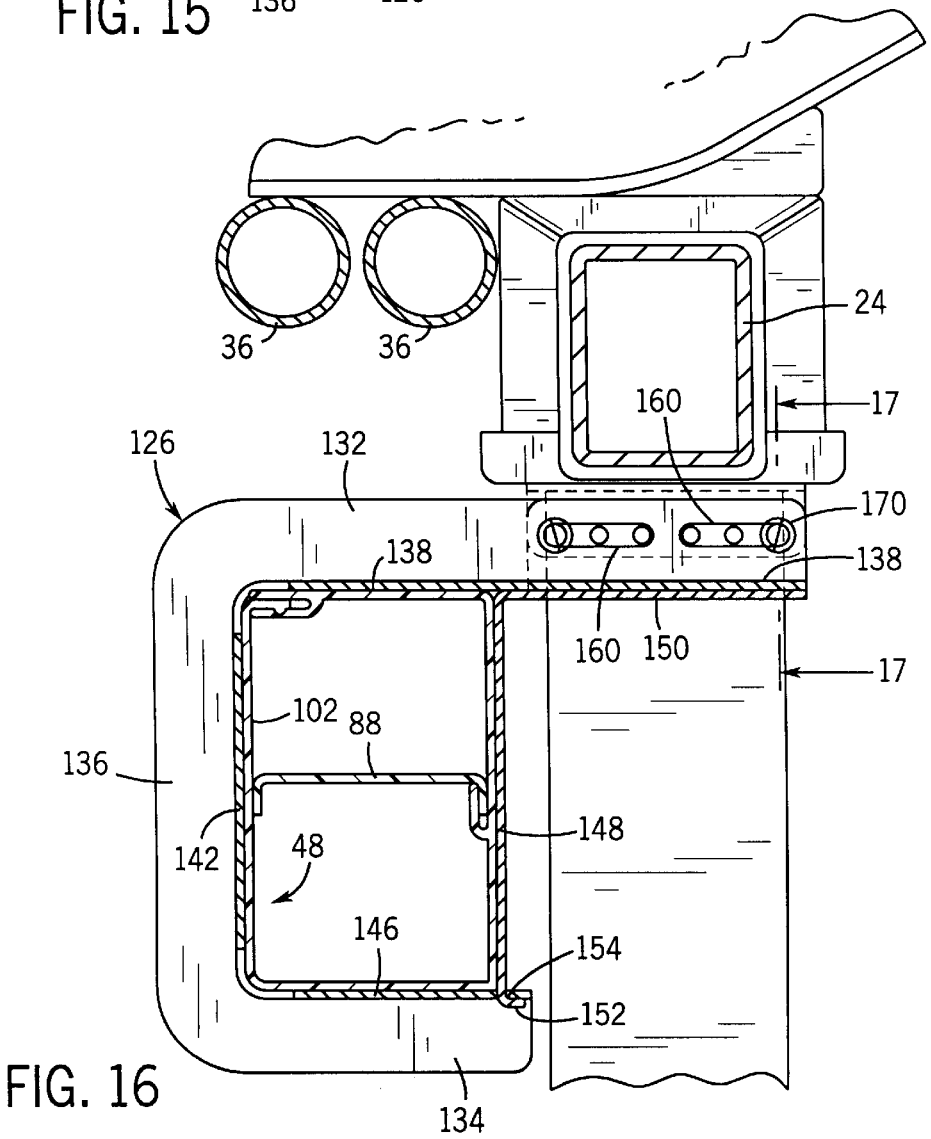
FIG. 16 is a partial section view taken along line 16—16 of FIG. 3.

When the first portion 128 and the second portion 130 of the bellows support bracket 126 are connected as shown in FIG. 16, the horizontal flange 150 of the second portion 130 is positioned below and in contact with the upper wing 138 of the first portion 128. In this manner, the bellows support bracket 126 encompasses the bellows 50 and a pair of slots 158 formed in a vertical attachment flange 156 of the second portion 130 are generally aligned with a second pair of slots 160 formed in the upper flange 132 of the first portion of the bellows support bracket 126.

Figure 17:
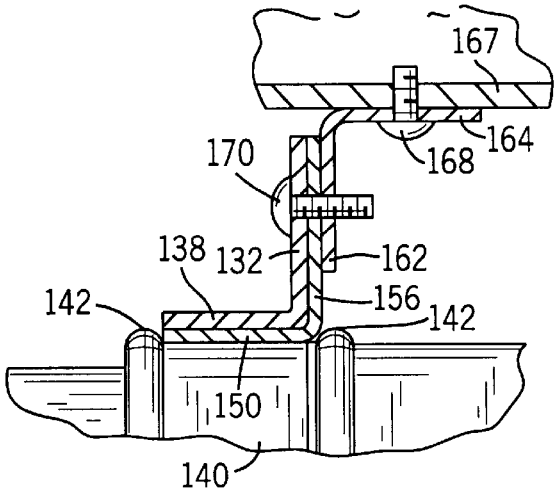
FIG. 17 is a partial section view taken along line 17—17 of FIG. 16 illustrating the interconnection between the wireway and the support beam.

A mounting bracket 162, including a horizontal portion 164 and a vertical portion 166, is secured to a flange 167 of the vertical upright 26, as best shown in FIGS. 14 and 17. Specifically, a pair of thread forming connectors 168 pass through openings within the horizontal portion 164 and are received within aligned pilot holes (not shown) formed in the flange 167.

After the mounting bracket 162 has been installed, the bellows support bracket 126 is secured to the mounting bracket 162 by a pair of connectors 170 that pass through the slots 160 formed in the upper flange 132 and the aligned slots 158 formed in the vertical attachment flange 156. As can be understood in the drawings, the wireway 40, and specifically the bellows 50, is supported beneath the flange 167 by the interconnection between the mounting bracket 162 and the bellows support bracket 126. Thus, the power and data distribution system 38 can be attached to the beam-mounted seating structure 20 after the seating structure 20 has been installed. In this manner, beam-mounted seating structures 20 that have previously been installed in a facility can be retrofit by simply adding the power and data distribution system 38 of the present invention, or power and data distribution system 38 can be installed at the same time as seating structure 20 is installed.

In addition to the bellows support bracket 126 that supports the wireway 40 beneath each of the seat assemblies 22, a series of wireway mounting brackets 172 (FIG. 3) are used to support the wireway 40 along the support beam 24 at locations other than bellows 50. The wireway mounting brackets 172 are positioned between adjacent seat assemblies 22 that do not have one of the access housings 42 positioned therebetween, as is illustrated in FIG. 2, at regular intervals along the length of wireway 40.

Figure 18:
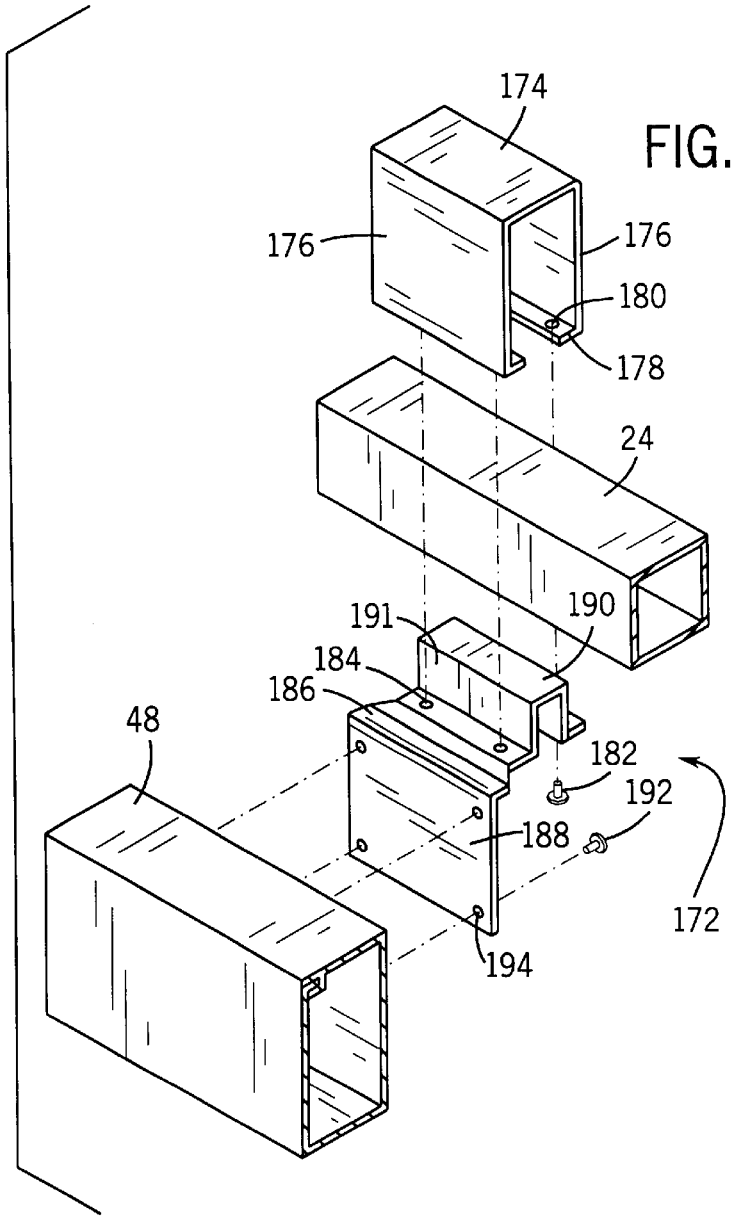
FIG. 18 is an exploded isometric view illustrating the mounting arrangement between the wireway section and the support beam.
Figure 19:
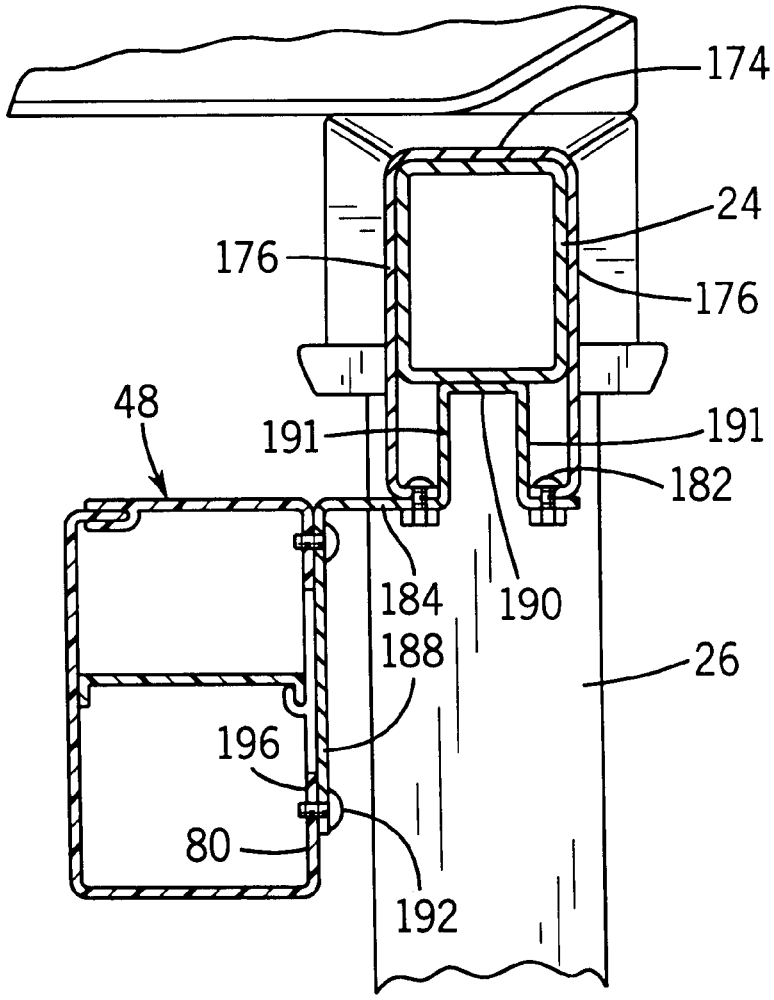
FIG. 19 is section view taken along line 19—19 of FIG. 3 further illustrating the mounting arrangement between the wireway section and the support beam.

Referring now to FIGS. 18 and 19, the wireway mounting bracket 172 includes a mounting strap 174 that is sized to surround the outer surface of the rectangular support beam 24. The mounting strap 174 includes a pair of extended sidewalls 176 that are longer than the height of the support beam 24. As can be seen in FIG. 19, when the mounting strap 174 is installed over the support beam 24, each of the sidewalls 176 extends downward past the bottom wall of the support beam 24.

The mounting strap 174 is installed on the support beam 24 by first spreading the sidewalls 176 and then sliding the mounting strap 176 downward onto the support beam 24. Therefore, the mounting straps 174, and thus the entire wireway mounting bracket 172, can be installed after the seating structure 20 has been installed. Each of the sidewalls 176 terminates with an attachment flange 178 that extends perpendicular to the sidewall 176. Each attachment flange 178 extends toward the center of the mounting strap 174 and includes a pair of openings 180 that each receive a connector 182. The connectors 182 extend through openings 184 formed in base plate 186 and are received within the aligned opening 180 formed in the attachment flanges 178. The base plate 186 is connected to a vertical mounting plate 188 and includes a support wall 190 that is set off from the base plate 186 by vertical walls 191. The support wall 190 contacts the bottom wall of the support beam 24 when the mounting strap 174 is positioned surrounding the support beam 24 and connected to the base plate 186 by the connectors 182.

The vertical mounting plate 188, in turn, is fastened to the inner wall 80 of the wireway section 48 by a series of connectors 192 that pass through aligned openings 194 and 196 formed in the mounting plate 188 and wireway section 48, respectively. Thus, as can be seen in FIG. 19, the wireway section 48 is supported by wireway mounting bracket 172 both beneath and below the support beam 24 for the beam-mounted seating structure 20.

As can be seen in FIG. 3, in addition to providing support for the wireway 40 beneath the support beam 28, the wireway mounting bracket 172 closes off the openings 82 formed in the wireway section 48 that do not receive one of the access housings 42. Since one of the access housings 42 is connected only to every other wireway section 48, the wireway mounting bracket 172, and specifically the mounting plate 188, covers the opening 82 in the wireway section 48. In this manner, each of the wireway sections 48 can be formed in an identical manner without requiring different sections to be used when constructing the power and data distribution system 38 of the present invention.

Although the power and data distribution system 38 of the present invention is shown and described including an access housing 42 connected to every other wireway section 48 such that each access housing 42 services a pair of adjacent seating assemblies 22, it is contemplated by the inventor that an access housing 42 could be positioned between each of the individual seat assemblies 22. In this alternate configuration, each of the seat assemblies 22 would have access to electrical outlets 44 and data outlets 46 on each side of the seating assembly 22. This alternate configuration would also provide each seat occupant with access to two electrical outlets 44 and two data outlets 46.

Referring now to FIGS. 6 and 7, the access housing 42 is a three-part, molded plastic member that is supported by both the wireway housing 48 and the support beam 24. The access housing 42 includes an upper attachment portion 194, a bottom drawer portion 196 and a front receptacle mounting portion 198. As can be seen in FIGS. 3 and 6, the receptacle mounting portion 198 includes openings to mount both of the electrical outlets 44 and both of the data outlets 46. A face plate 200 surrounds the data outlets 46 and is positioned between the drawer portion 196 and the receptacle mounting portion 198. The face plate 200 is a separate component that is received in a pair of opposed vertical slots formed in the mounting portion 198. The specific configuration of the face plate 200 is selected by the user depending on the specific type of data outlet 46 selected. During installation, the data lines 76 and data outlets 46 are attached to the face plate 200 and the face plate 200 is slid into place.

Referring back to FIG. 6, the receptacle mounting portion 198 includes a divider wall 202 that separates the electrical outlets 44 from the data outlets 46. The divider wall 202 includes both a horizontal portion and a vertical portion to isolate the electrical wiring from the data lines 76. The vertical portion of the divider wall 202 is coupled to a horizontal plate 204 that includes an opening 206. The opening 206 is sized to allow the branch electrical conduit 74*a* to pass through the horizontal plate 204. In addition to the opening 206, the receptacle mounting portion 198 includes a threaded saddle 205 that securely receives the branch electrical conduit 74*a*. In addition to the threaded saddle 205, the upper attachment portion 194 includes a pair of spaced vertical walls (not shown) that grip the branch electrical conduit 74*a* after it passes through the saddle 205. The combination of the vertical walls on the upper attachment portion 194 and the saddle 205 on the receptacle mounting portion 198 provide enough interference to restrict the branch electrical conduit 74*a* from rotating and thus provides strain relief.

In the preferred embodiment of the invention, once the electrical outlets 44 and the data outlets 46 have been connected to the electrical wiring and data lines 76, the front receptacle mounting portion 198 is secured to the upper attachment portion 194 by either ultrasonic welding or an adhesive. In this manner, the upper attachment portion 194 and front receptacle mounting portion 198 become a unitary structure that can be mounted to both the support beam 24 and the wireway 40 in the manner to be discussed below.

The bottom drawer portion 196 is aligned by tongue and groove and secured to the receptacle mounting portion 198 by a pair of screws (not shown) that are accessible through a pair of access passages 208 formed in an angled front wall 207 of the bottom drawer portion 196. When the bottom drawer portion 196 is removed from the access housing 42, as shown in FIG. 7, the internal wiring contained within the access housing 42 is accessible for any required repairs. In addition to the connection to the receptacle mounting portion 198, the bottom drawer portion 196 includes a support tab 209 that is received in an opening formed in the inner wall 80 of the wireway section 48, as shown in FIG. 6.

Referring now to FIG. 7, the attachment portion 194 of the access housing 42 is attached to the support beam 24 by a mounting strap 210. Specifically, the mounting strap 210 includes a pair of sidewalls 212 that extend downward from a top wall 214 and terminate with a perpendicular attachment flange 216. Each of the sidewalls 212 is longer than the height of the rectangular support beam 24 such that a horizontal back surface 218 of the upper attachment portion 194 is positioned below the support beam 24. A series of connectors 220 pass upward through holes 224 formed in the back surface 218 and are threadedly received in corresponding openings 222 formed in the attachment flanges 216. In this manner, the attachment portion 194 can be attached to the support beam 24 after the seating structure has been installed. A pair of standoffs 226 extend upward from the back surface 218 and contact the bottom wall of the support beam 24, as shown in FIG. 6.

In addition to being mounted to the support beam 24 by the mounting trap 210, the upper attachment portion 194 of the access housing 42 is mounted to the wireway section 48 by a series of connectors 228 that pass through the inner wall 80 of the wireway section 48 and are received within openings 230 formed in the rear surface 86 of the upper attachment portion 194, as shown in FIGS. 5 and 7. The connectors 228, as shown in FIG. 5, are installed by moving the back panel 102 of the wireway section 48 to its open, access position as shown in phantom in FIG. 10. When the back panel 102 is open, the connectors 228 can be screwed into the openings 230 contained in the back surface 86.

It is important to note that a significant feature of the present invention is the ability to mount the power and data distribution system 38 to the support beam 24 after the beam-mounted seating structure 20 has been installed. In this manner, the power and distribution system 38 can either be installed at the same time the beam-mounted seating structure 20 is installed, or installed on pre-existing seating structures 20 that have been in place for quite some time. It is contemplated by the inventor that the power and data distribution system 38 constructed in accordance with the present invention could be used to retrofit existing beam-mounted seating structures 20 in order to update a lecture hall or auditorium with both power and data access. Since the bellows mounting bracket 126, the wireway mounting brackets 172, and the mounting straps 210 can be positioned at various locations along the support beam 24, the power and data distribution system 38 of the present invention can easily be modified to be usable with various types of beam-mounted seating structures 20 other than the one illustrated in the drawings.

Various alternatives and embodiments are contemplated as being within the scope of the following claims particularly pointing out and distinctly claiming the subject matter regarded as the invention.

What is claimed is:

1. A power distribution system for use in combination with a seating structure having a plurality of individual seat assemblies aligned in a row, each seat assembly being mounted to a support beam that extends beneath the seat assemblies, the power distribution system comprising:

a wireway adapted for attachment to the support beam and extending beneath the seating structure;

an electrified main electrical conduit extending through the wireway; and a plurality of access housings extending from the wireway, each access housing including at least one electrical outlet that is coupled to the main electrical conduit to provide electrical power to the electrical outlet.

2. The power distribution system of claim 1 wherein the wireway is attachable beneath the support beam by a plurality of mounting brackets.

3. The power distribution system of claim 2 wherein each access housing extends both outward and upward from the wireway such that the electrical outlet contained within each access housing is positioned above the wireway.

4. The power distribution system of claim 1 wherein the wireway includes a plurality of individual wireway sections, wherein adjacent wireway sections are joined to each other by an extendible bellows.

5. The power distribution system of claim 4 further comprising a plurality of secondary support brackets positioned to support the wireway between adjacent seat assemblies, each of the secondary support brackets including a mounting strap that receives and surrounds the support beam and is attached to a base plate secured to the wireway such that the secondary support bracket supports the wireway from the support beam.

6. The power distribution system of claim 4 wherein each of the mounting brackets surrounds a portion of one of the bellows and is attachable to the support beam beneath one of the seat assemblies.

7. The power distribution system of claim 6 wherein each of the mounting brackets includes a generally C-shaped first portion detachably joined to a second portion such that the assembled mounting bracket is sized to surround the bellows.

8. The power distribution system of claim 1 wherein each access housing includes two electrical outlets and is positioned between a pair of adjacent seat assemblies such that the access housing supplies electrical power to the pair of seat assemblies.

9. The power distribution system of claim 1 further comprising at least one data outlet contained on each access housing.

10. The power distribution system of claim 9 further comprising a plurality of data lines extending through the wireway, each data line having a first end coupled to one of the data outlets to provide data communication to the data outlet.

11. The power distribution system of claim 10 wherein each access housing includes two electrical outlets and two data outlets, each access housing being positioned between a pair of adjacent seat assemblies to supply electric power and data communication to the pair of seat assemblies.

12. The power distribution system of claim 10 wherein each of the plurality of data lines includes a second end connected to a main data terminal.

13. The power distribution system of claim 10 wherein the wireway includes a divider that separates the plurality of data lines from the main electrical conduit.

14. The power distribution system of claim 13 wherein the wireway includes an inner wall having an extended flange that defines a divider channel, the divider channel sized to receive a mounting portion of the divider to support the divider along the inner wall of the wireway.

15. The power distribution system of claim 14 wherein the mounting portion of the divider includes a detent that is received in a mating groove formed in the flange extending from the inner wall of the wireway.

16. The power distribution system of claim 10 wherein the wireway is formed from a plastic material and includes an integral back panel movable between a closed, latched position and an open, access position to permit access to the main electrical conduit and the plurality of data lines contained within the wireway.

17. The power distribution system of claim 1 wherein each access housing is supported by both the wireway and the support beam.

18. The power distribution system of claim 17 further comprising a mounting strap positioned to surround the support beam and having a pair of attachment flanges that are securely attached to the access housing such that the mounting strap supports the access housing beneath the support beam.

19. The power distribution system of claim 18 wherein each of the mounting straps includes a pair of spaced sidewalls that are separable to permit attachment of the mounting strap to the support beam.

20. The power distribution system of claim 17 wherein each access housing includes a drawer portion removably mounted to an upper attachment portion, the upper attachment portion being mounted to both the wireway and the support beam.

21. A power and data distribution system for use in combination with a seating structure having a plurality of individual seat assemblies aligned in a row, each seat assembly being mounted to a support beam that extends beneath the row of seats, the power and distribution system comprising:

a wireway adapted for attachment to the support beam and extending beneath the seating structure;

a plurality of access housings extending from the wireway, each access housing including at least one electrical outlet and at least one data outlet;

an electrified main electrical conduit extending through the wireway, wherein each electrical outlet is coupled to the main electrical conduit; and a plurality of data lines extending through the wireway, each data line being coupled to one of the data outlets.

22. The power and data distribution system of claim 21 wherein each access housing includes two electrical outlets and two data outlets, each access housing being positioned between a pair of adjacent seat assemblies to supply electric power and data connections to the pair of seat assemblies.

23. The power and data distribution system of claim 21 further comprising a divider contained in the wireway to separate the main electrical conduit from the plurality of data lines.

24. The power distribution system of claim 23 wherein the wireway includes an inner wall having an extended flange that defines a divider channel, the divider channel sized to receive a mounting portion of the divider to support the divider along the inner wall of the wireway.

25. The power distribution system of claim 24 wherein the mounting portion of the divider includes a detent that is received in a mating groove formed in the flange extending from the inner wall of the wireway.

26. The power and data distribution system of claim 21 wherein each access housing extends both upward and outward form the wireway such that the electrical outlet and data outlet of each access housing is positioned above the wireway.

27. The power and data distribution system of claim 21 wherein the wireway is formed from a plastic material and includes an integral back panel movable between a closed, latched position and an open, access position.

28. The power and data distribution system of claim 21 wherein each access housing is supported by both the wireway and the support beam.

29. The power distribution system of claim 28 further comprising a mounting strap positioned to surround the support beam and having a pair of attachment flanges that are securely attached to the access housing such that the mounting strap supports the access housing beneath the support beam.

30. The power distribution system of claim 29 wherein each of the mounting straps includes a pair of spaced sidewalls that are separable to permit attachment of the mounting strap to the support beam.

31. The power and data distribution system of claim 28 wherein each access housing includes a drawer portion removably mounted to an upper attachment portion, the upper attachment portion being mounted to both the wireway and the support beam.

32. A seating system having a plurality of individual seat assemblies aligned in a row, each seat assembly mounted to a support beam that extends beneath the entire row of seats to support each of the seats in the row, the seating system comprising:

means for distributing electric power and data communications along the row of seats and coupled to the support beam; and means for providing access to the electric power and data communications for an occupant of each seat assembly.

33. The seating system of claim 32 wherein the distributing means is positioned below each seat assembly and supported by the support beam.

34. The seating system of claim 32 wherein the means for providing access to the electric power and data extends outwardly and upwardly from the support beam.

35. A seating system comprising:

a plurality of individual seat assemblies aligned in a row, each seat assembly mounted to a common support beam that extends beneath the entire row of seat assemblies;

a wireway mounted to the support beam and extending along at least a substantial portion of the support beam;

a plurality of access housings extending from the wireway, each access housing including at least one electrical outlet and at least one data outlet;

an electrified main electrical conduit extending through the wireway, wherein each electrical outlet is coupled to the main electrical outlet to provide electric power to the electrical outlet; and a plurality of data lines extending through the wireway, each data line being coupled to one of the data outlets contained on the access housings.

36. The seating system of claim 35 wherein the wireway includes a divider that separates the plurality of data lines from the main electrical conduit.

37. The seating system 35 wherein each access housing includes two electrical outlets and two data outlets, each access housing being positioned between a pair of adjacent seat assemblies to supply electric power and data communication to the pair of seat assemblies.

38. The seating system of claim 35 wherein each access housing is supported by both the wireway and the support beam.

39. The seating system of claim 38 further comprising a mounting strap positioned to surround the support beam and having a pair of attachment flanges that are securely attached to the access housing such that the mounting strap supports the access housing beneath the support beam.

40. The seating system of claim 39 wherein each of the mounting straps includes a pair of spaced sidewalls that are separable to permit attachment of the mounting strap to the support beam.

41. The seating system of claim 35 wherein the wireway is removably attachable to the support beam by a plurality of mounting brackets.

42. The seating system of claim 41 wherein the wireway is formed from a plastic material and includes an integral back panel movable between a closed, latched position and an open, access position to prevent access to the main electrical conduit and plurality of data lines contained within the wireway.

43. The seating system of claim 42 wherein the wireway includes a plurality of individual wireway sections, wherein adjacent wireway sections are joined to each other by an extendible bellows.

44. The seating system of claim 43 wherein each of the mounting brackets surrounds a portion of one of the bellows and is attachable to the support beam beneath one of the seat assemblies.

45. The seating system of claim 35 wherein the main electrical conduit is coupled to an infeed electrical conduit that is coupled to the power supply for the facility in which the seating system is located.

46. A method of providing access to a data network and a source of electricity for each seat occupant in a seating structure having a plurality of seat assemblies aligned in a row and supported on a common support beam, the method comprising the steps of:

mounting a wireway to the support beam beneath the row of seat assemblies;

positioning an electrified main electrical conduit and a plurality of data lines in the wireway;

attaching an access housing to the wireway adjacent to one side of each seat assembly, each access housing having at least one electrical outlet and at least one data outlet; and connecting each electrical outlet to the main electrical conduit and connecting each data outlet to one of the data lines to provide the seat occupant with access to the data network through the data outlet and access to the source of electricity through the electrical outlet.

47. The method of claim 46 wherein the step of mounting the wireway to the support beam includes positioning a mounting bracket to surround the support beam beneath each seat assembly and attaching the mounting bracket to the wireway such that the wireway is supported by the support beam.

48. The method of claim 46 further comprising the step of joining a plurality of wireway sections by a bellows positioned between adjacent wireway sections to form the wireway.

49. The method of claim 46 wherein the step of attaching the access housing includes attaching the access housing to a mounting strap that surrounds the support beam such that the access housing is supported by both the wireway and the support beam.

50. The method of claim 46 further comprising the step of inserting a divider into the wireway to separate the electrified main electrical conduit from the plurality of data lines.

* * * * *